US011149925B2

(12) United States Patent
Bergman et al.

(10) Patent No.: US 11,149,925 B2
(45) Date of Patent: Oct. 19, 2021

(54) LIGHTING DEVICE INCLUDING ADJUSTABLE COVER

(71) Applicant: SIGNIFY HOLDING B.V., Eindhoven (NL)

(72) Inventors: Anthonie Hendrik Bergman, Eindhoven (NL); Tim Dekker, Eindhoven (NL); Jochen Renaat Van Gheluwe, Eindhoven (NL); Bartel Marinus Van De Sluis, Eindhoven (NL)

(73) Assignee: Signify Holding B.V., Eindhoven (NL)

( * ) Notice: Subject to any disclaimer, the term of this patent is extended or adjusted under 35 U.S.C. 154(b) by 0 days.

(21) Appl. No.: 16/306,591

(22) PCT Filed: May 22, 2017

(86) PCT No.: PCT/EP2017/062265
§ 371 (c)(1),
(2) Date: Dec. 3, 2018

(87) PCT Pub. No.: WO2017/211579
PCT Pub. Date: Dec. 14, 2017

(65) Prior Publication Data

US 2019/0186714 A1 Jun. 20, 2019

(30) Foreign Application Priority Data

Jun. 9, 2016 (EP) ..... 16173665

(51) Int. Cl.
*F21V 14/08* (2006.01)
*F21S 6/00* (2006.01)
(Continued)

(52) U.S. Cl.
CPC ..... *F21V 14/08* (2013.01); *F21S 4/28* (2016.01); *F21S 6/005* (2013.01); *F21S 8/033* (2013.01);
(Continued)

(58) Field of Classification Search
CPC .... F21S 8/033; F21S 8/06; F21V 1/08; F21V 9/045; F21V 11/04; F21V 14/04;
(Continued)

(56) References Cited

U.S. PATENT DOCUMENTS 4,298,916 A 11/1981 Schmitz
7,217,009 B2 5/2007 Klose
(Continued)

FOREIGN PATENT DOCUMENTS

CN 102356268 A 2/2012
CN 103688100 A 3/2014
(Continued)

OTHER PUBLICATIONS

Ito, JP-2005177149-A, English machine translation, Jul. of 2005 (Year: 2005).*

*Primary Examiner* — Evan P Dzierzynski
*Assistant Examiner* — Keith G. Delahoussaye
(74) *Attorney, Agent, or Firm* — Daniel J. Piotrowski

(57) ABSTRACT

The invention provides a lighting device (100) comprising a surface-mountable elongated carrier (200) for positioning relative to a surface (300), at least one light source (400), and an adjustable cover (500); wherein the elongated carrier (200) comprises opposite to each other a first face (210) on a first side and a second face (220) on a second side, the at least one light source (400) is located on the first (210) and second face (220); and 5 wherein the elongated carrier (200) comprises a third face (230) on a third side for facing the surface (300) in mounted position; and wherein the adjust-
(Continued)

able cover (500) is in connection with the carrier (200) and is positioned on a fourth side of the carrier (200) opposite to the third side, and wherein the adjustable cover (500) is movable relative to the elongated carrier (200) for controlling a light effect (600) originating from the at least one light source (400) 10 wherein the at least one light source (400) comprises a LED light source.

13 Claims, 10 Drawing Sheets

(51) Int. Cl.

| | |
|---|---|
| ***F21S 8/00*** | (2006.01) |
| ***F21S 4/28*** | (2016.01) |
| *F21Y 103/00* | (2016.01) |
| *F21Y 115/10* | (2016.01) |
| *F21Y 107/90* | (2016.01) |

(52) U.S. Cl.
CPC ..... *F21Y 2103/00* (2013.01); *F21Y 2107/90* (2016.08); *F21Y 2115/10* (2016.08)

(58) Field of Classification Search
CPC ..... F21V 14/045; F21V 14/06; F21V 14/065; F21V 14/08; F21V 14/096; F21V 14/085
See application file for complete search history.

(56) References Cited

U.S. PATENT DOCUMENTS

| | | | | |
|---|---|---|---|---|
| 8,167,434 | B2 | 5/2012 | Overes | |
| 8,702,265 | B2 * | 4/2014 | May | F21S 8/04 362/147 |
| 2005/0207156 | A1 * | 9/2005 | Wang | F21K 9/00 362/240 |
| 2010/0180615 | A1 * | 7/2010 | Linder | A47F 3/0434 62/248 |
| 2012/0002409 | A1 | 1/2012 | Donauer | |
| 2013/0170201 | A1 * | 7/2013 | Chen | F21V 17/02 362/233 |

FOREIGN PATENT DOCUMENTS

| | | | |
|---|---|---|---|
| CN | 204005495 | U | 12/2014 |
| CN | 204345396 | U | 5/2015 |
| CN | 104712956 | A | 6/2015 |
| CN | 204437805 | U | 7/2015 |
| EP | 1517080 | A2 | 3/2005 |
| EP | 2243999 | A1 | 10/2010 |
| FR | 2385979 | A | 10/1978 |
| JP | 2005177149 | A | 7/2005 |
| WO | 2014167453 | A1 | 10/2014 |
| WO | 2016050872 | A1 | 4/2016 |

* cited by examiner

LIGHTING DEVICE INCLUDING ADJUSTABLE COVER

CROSS-REFERENCE TO PRIOR APPLICATIONS

This application is the U.S. National Phase application under 35 U.S.C. § 371 of International Application No. PCT/EP2017/062265, filed on May 22, 2017, which claims the benefit of European Patent Application No. 16173665.7, filed on Jun. 9, 2016. These applications are hereby incorporated by reference herein.

FIELD OF THE INVENTION

The invention relates to a lighting device comprising a carrier for positioning relative to a surface and at least one light source, and to a system comprising the lighting device and a control unit.

BACKGROUND TO THE INVENTION

Such lighting device is known for example from US2012/0002409 A1 which discloses a mount having at least one semiconductor light source, where the mount has an elongated basic form and is designed to include at least two functionalities. Of which at least one is a lighting functionality. To implement the at least one lighting functionality, the mount includes at least one semiconductor light source, in particular a LED light source.

In order to prevent dazzle, the lighting device of US2012/0002409 A1 screens its light source from external view by substantially having an H-shape or T-shape cross section. In particular, a view screening element can then be mounted on the side facing away from the semiconductor light source. Although dazzle is somewhat prevented, it is a disadvantage that such lighting device is still limited in application to prevent further dazzle or glare. US2012/0002409 A1 comprises a mount with multiple functionalities, of which at least one is a lighting functionality, a disadvantage of such a mount remains that the lighting application cannot be utilized in its full potential.

SUMMARY OF THE INVENTION

It is an object of the invention to provide a lighting device, which prevents glare irrespective of a position of the lighting device relative to a surface and at the same time to allow the light effect of the lighting device to be controlled.

Thereto, the invention provides a lighting device comprising a surface-mountable elongated carrier for positioning relative to a surface, at least one light source, and an adjustable cover; wherein the elongated carrier comprises opposite to each other a first face on a first side and a second face on a second side, the at least one light source is located on the first and second face; and wherein the elongated carrier comprises a third face on a third side for facing the surface in mounted position; and wherein the adjustable cover is in connection with the carrier and is positioned on a fourth side of the carrier opposite to the third side, and wherein the adjustable cover is movable relative to the elongated carrier for controlling a light effect originating from the at least one light source, wherein the at least one light source comprises a LED light source. Said light effect may be to prevent the perception of glare being observed by an observer facing the surface. The glare is being caused by the at least one light source and the position of the carrier relative to the surface.

Said at least one light source is a LED light source.

Said surface may be an architectonic surface, like a wall, a ceiling, a window, a façade, or a floor. The surface may also be a surface of another object like furniture, a screen or a vehicle. In an embodiment, the elongated carrier comprises a third face on a third side, which is facing towards the surface in mounted position.

Said first, second, third and fourth side can be considered as one of the six sides of a cube (e.g. top, bottom, left, right, front back) within a Cartesian coordinate system. The shortest distance between opposite sides is then the line orthogonal between corresponding opposite faces of the cube.

Said third side is the side on which the lighting device projects the light effect on the surface. The fourth side is the side of the lighting device where the adjustable cover is present and is typically in connection with the elongated carrier. Alternatively, the adjustable cover may be connected to the carrier via the first or second faces, or via the end faces of the elongated carrier, which mark the ends of the elongated carrier in the elongated direction.

The elongated carrier is mountable to a surface. The surface to which the lighting device is mounted does not have to be the same to the surface towards which the lighting device is positioned to. The phrase mountable is in this application not limited to only mechanical means of mounting, but also includes alternatives, like means of mounting comprising gravitational force if the lighting device is supported by a surface without being fixed to the surface, magnetic force, chemical bonds like adhesive force. As mentioned before, the surface-mountable elongated carrier is not restricted to be mountable to the surface the lighting device is positioned to. The elongated carrier can also be mountable to any other surface suitable for mounting the described lighting device. For example, a surface mountable elongated carrier that is placed on a floor (or stands on an edge) is mounted to the floor (or edge) by means of gravitational force; and further, while mounted to the floor, the surface mountable elongated carrier can be positioned facing towards a wall, which will be the said third side.

The adjustable cover is in connection with the carrier and is positioned on a fourth side opposite to the third side. On said fourth side, a fourth face of the elongated carrier, which is opposite to the third face, will be facing the adjustable cover. The phrase in connection with is not limited in this application to only mechanical means of being in connection, but also includes alternative means of being in connection with. The adjustable cover can be in connection with the carrier by means of mechanical connection elements like e.g. screws, nails, clips, snap-fits, rods, tight fits, bearings; or by means of alternative forces like e.g. magnetic force, adhesive force, and friction forces. Being in connection with the carrier, the position of the adjustable cover can be varied with respect to the carrier.

The elongated carrier of the lighting device is furthermore easily mountable and de-mountable, such that the elongated carrier can be easily re-positioned relative to a surface.

One advantage of such a lighting device is that glare can be prevented for each position the lighting device is positioned relative to a surface, because the adjustable cover can be repositioned and thus block the at least one light source from a line of sight. More specifically, when the lighting device is positioned below an observer's point of view, the adjustable cover can be moved upwards to shield the light source from direct view by said observer and prevent glare;

and when the lighting device is positioned above an observer's point of view, the adjustable cover can be moved downwards to shield the light source from direct view by said observer and prevent glare. In case the lighting device is positioned at an alternative height of an observer's point of view, the adjustable cover can be positioned such that a desired result is achieved. The adjustable cover will therefore add value to the functionality of the lighting device. The proposed lighting device provides, for example, an advantage for use in retail, use in entertainment sector, domestic use, interior design, exhibitions and hospitality sector; because in these sectors lighting devices may be relocated to accommodate another lighting setting for multiple observers, thus the lighting device according to the present invention may be useful in providing the ability to be re-positioned such that glare is prevented irrespective of a position of the lighting device relative to a surface.

Another advantage of such a lighting device is that the cut-off angle of the at least one light source may be controlled by the adjustable cover. As the cut-off angle of light determines the smoothness, light transition and overall quality of the light projection on a surface, the presence of the adjustable cover will enable achieving a desired light effect. For example, the lighting device may be positioned to a wall and used to project light as a wall-washing effect, while simultaneously projecting a ceiling-washing effect on a ceiling. In this case, the ceiling-washing effect uses a larger cut-off angle to illuminate the ceiling, while the wall-washing effect uses a small cut-off angle. By moving the adjustable cover downwards, the light sources are blocked such that the abovementioned cut-off angles are set accordingly. At the same time, glare is prevented.

Hence, in an embodiment, the light effect originating from the at least one light source on the first and second face of the elongated carrier is controlled simultaneously by the positioning of the adjustable cover with respect to the elongated carrier.

In case more than one light source is present in the lighting device, the more than one light source can, as mentioned before, be located on the first and second face of the elongated carrier. For example, the location of the more than one light source may be all on the first face and all on the second face of the elongated carrier, whereby more than one light source is positioned consecutively in the direction perpendicular to the square plane set by the first, second, third and fourth side (i.e. the elongated direction of the carrier, the direction between the end faces of the elongated carrier). Thus, the location of the more than one light source may also be on both the first face and the second face. If more than one light source is present on one face, they are positioned consecutively in the direction perpendicular to the square plane set by the first, second, third and fourth side (i.e. the elongated direction of the elongated carrier, the direction between the end faces of the elongated carrier). Considering the Cartesian coordinate system mentioned before, the first and second side may thus be top and bottom, while the third and fourth side may be front and back, and the elongated direction of the carrier may be the axis between the remaining fifth (left) and sixth (right) side. As mentioned before, the end faces of the elongated carrier will thus be the faces that mark the ends of the elongated carrier, the end faces thus being on said fifth and sixth side.

The adjustable cover can thus be used to advantageously control the light effect originating from the at least one light source, which includes controlling the perception of glare caused by the at least one light source and the positioning of the carrier relative to the surface. Hence, in an embodiment, the adjustable cover is moveable with respect to the carrier in a direction perpendicular to the direction defined by the shortest distance between the third side and fourth side. As mentioned before, the adjustable cover is also moveable relative to the elongated carrier for controlling a light effect originating from the at least one light source. The movement of the adjustable cover may include translation and/or rotation within the plane set by the direction perpendicular to the direction defined between the third side and the fourth side. Rotational and translational movement enables more control of the at least one light source to prevent glare, to set desired cut-off angles, and to enable various light effects.

Furthermore, in an embodiment, the adjustable cover is only moveable with respect to the carrier in the direction perpendicular to the direction defined by the shortest distance between the third side and the fourth side, whereby said perpendicular direction is the direction defined by the shortest distance between the first side and the second side. By limiting the movement of the adjustable cover to only said perpendicular direction defined by the shortest distance between the first side and the second side, more dedicated control is achieved to prevent glare, to set desired cut-off angles, and to enable various light effects corresponding to that direction.

The positioning of the adjustable cover with respect to the elongated carrier is relevant for the light effect generated by the at least one light source. This light effect may be any effect that is physically possible by the at least one light source and the positioning of the adjustable cover. In an embodiment, the at least one light source and the adjustable cover are arranged for generating a light effect such as a wall-washing effect or a ceiling washing effect. As the lighting device provides the advantages mentioned before related to glare prevention and cut-off angle setting, the functionality of the lighting device suites well with providing surface-washing or ceiling-washing effects.

In other embodiments, the light effect may be derived from scenes in nature, which are subsequently mimicked by means of actively controlling the light output of the at least one light source with a control unit. Said scenes of nature may be: sunset and sunrise, in which a projected light image of a sun is rising, setting or periodically moving along the first or second side of the elongated carrier. The light effect derived from scenes in nature may further comprise any one or a combination of the following light effects. Moonlight, in which a moon is projected as light effect in an evening or night sky. Cloudy skies, in which clouds and the movement of clouds are projected as light effect either on the first or second side or both. Rainfall, in which raindrops are projected as light effect together with or separately from cloudy skies. Waterfronts, in which the horizon of a water entity is mimicked within the light effect. Waterfalls or water flow, in which the movement of water is projected as light effect on the projected surface. Turbulence, in which the turbulent flow of natural convection or any other source of turbulence in nature is mimicked as light effect onto the surface. Tree-line, in which a colored forest is mimicked as light effect by a light source on the first side and the sky or a lake is projected as light effect by a light source on the second side. Fire, in which fire is projected as light effect on the projected surface either with or without additional presence of fireflies.

Due to the presence of straight separations usually extending horizontally in many scenes in nature, the lighting device as presented in this application—comprising a surface-mountable elongated carrier for positioning relative to a surface, at least one light source and an adjustable cover—is therefore well suited to mimic said scenes in nature. These scenes in nature may for example be used to calm observers (e.g. patients) in a room.

Besides scenes in nature, the light effect may also be derived from other non-nature scenes like: projection of a light effect comprising a representation of time in general, for example a calendar or clock. Projection of a predefined dynamic light choreography, or projection of a light effect to emphasize a sound or music arrangement, or projection of a light effect to mimic fluid dynamics patterns.

In some embodiments, to support the perception of the light effect of the lighting device, the adjustable cover may have a color matching the light effect. The color of the adjustable cover may be changed by replacing covers which have physically different colors, or dynamically by enabling light sources within the adjustable cover to change its color together with optics to diffuse this light. Thereto, in an embodiment, the adjustable cover is at least partly made out of a translucent material. The translucent material may be glass or colored glass or laminates with glass or plastics. It is also possible for the adjustable cover to consist of multiple parts. In an embodiment, the adjustable cover is at least partly made out of a translucent material; wherein the adjustable cover comprises an enclosing surface on which LED's are located facing inwards, such that the adjustable cover is illuminated by said LED's. In an embodiment, the adjustable cover comprises separately at least a first cover and a second cover, whereby the at least first cover and second cover are adjustable individually to determine the overall positioning of the adjustable cover with respect to the carrier. Hereby, the at least first cover and second cover may for example overlap partly, have a gap in between, or about each other. In another embodiment, the adjustable cover is made out of a flexible material. In these embodiments the cut-off angle and the prevention of glare can be controlled locally, while the overall effect remains.

The surface-mountable elongated carrier has an elongated form. In an embodiment, the shortest distance between the third face and the fourth face is equal to or smaller than four times the width of the largest light source present in the lighting device, wherein the width of the largest light source is defined by the shortest direction between the third side and the fourth side, and wherein the largest light source is defined as the light source having the largest width. Yet in other embodiments, the shortest distance between the third face and the fourth face is preferably not smaller than one and halve times the width of the largest light source present in the lighting device. Here, the phrase largest light source present in the lighting device comprises the at least one light source located on the faces of the elongated carrier. The largest width of the light source may, for example, include the width of a PCB on which a LED package is mounted to form a lighting device. These embodiments enable the lighting device to be advantageously compact. For example: a quite common option to create a wall-washing effect is to use a cove, which requires an expensive architectural approach or dedicated building elements. By using a surface-mountable elongated carrier, with the abovementioned distance between the third side and fourth side, the same wall-washing effect is achieved with a more compact, less expensive, more flexible, single lighting device.

In an embodiment, the surface-mountable elongated carrier consist out of a single, preferably extruded, piece. Alternatively, injection Extruded material of the elongated carrier might be a plastic, copper, carbon fiber, aluminum or a similar metal. For example, injection molding and extrusion enable the elongated carrier of the lighting device to be a single part, extrusion has the advantage of cheaper and faster production and easy mounting. The surface-mountable carrier will then typically be an elongated profile. This elongated profile may have the shape of an I, L, H, T, Y beam or any other shape able to host at least one light source and opposite to each other provide a first face on a first side and a second face on a second side. Injection molding has the advantage of enabling more complicated shapes and cavities for the elongated carrier of the lighting device.

In an embodiment, the surface-mountable elongated carrier is hollow. Being hollow, the surface-mountable elongated carrier comprises a cavity which is able to accommodate parts that enable the lighting function of the lighting device, e.g.: drivers, chipsets, heat sinks, wires, batteries. This enables a more compact lighting device. For example, the end faces of the elongated carrier may have a hollow rectangular cross-section, such that an elongated hollow rectangular profile is achieved in the elongated direction of the carrier. Said hollow rectangular cross-section improves the rigidity of the elongated carrier and comprises a cavity which is able to accommodate parts of the lighting device.

The term elongated means that the length of the carrier of the lighting device in the direction perpendicular to the direction defined by the shortest distance between the third side and the fourth side, and perpendicular to the direction defined by the shortest distance between the first side and second side, is at least 4 times, preferably at least 12 times larger than the distance defined by the shortest distance between third side and the fourth side. As a result of this, the lighting device is able to provide a light effect on a larger section of surface. For example surface-washing effects are improved with this elongated carrier.

Due to the development of LED lighting in general, lighting devices are able to produce more complicated light effects, while the size of the lighting device is decreased. Dynamic light effects are also made possible by LED lighting and control of LED lighting. Hence, as mentioned before, the at least one light source comprises a semiconductor lighting device, preferably a LED, OLED, LED strip, or a high density LED strip. This facilitates the lighting device of this application to achieve more versatile and functional light effects. These light effects are furthermore enhanced by the use of novel high density LED-strip arrangements, in which more LED's are able to be placed per meter. This prevents the pixilation of LED's and gives better surface-washing effects. Hence, in another embodiment, the at least one light source comprises a semiconductor lighting device with at least 90 LED light sources per meter or more, e.g. 100 LED light sources per meter, 120 LED light sources per meter, or 150 light sources per meter. Pixilation of the light sources of the lighting device will therefore be prevented and an increased range of opportunities will be possible for rendering light effects. In yet another embodiment, the at least one light source is located on the first and second face, wherein the at least one light source is arranged closer to the fourth face than to the third face of the elongated carrier. Thus the at least one light source is closer to the adjustable cover than to the third face. As a result of this arrangement, pixilation of the at least one light source of the lighting device, which may be seen in the light effect projected to the surface, is prevented due to improved mixing, because the at least one light source is arranged closer to the adjustable cover than to the third face of the elongated carrier. Another benefit of this arrangement is that the adjustable cover may be smaller in height as the at least one light source is arranged closer to the adjustable cover than to the third face of the elongated carrier. In another embodiment, the at least one light source has a fixed illumination direction. As a result, no moving parts are required in the lighting device, such that said embodiment with a fixed illumination direction will enable a more compact and less complicated lighting device.

The application of a LED strip as the at least one light source will enable the lighting device to be compact, such that it can be positioned closer to the surface, while still having an advantageous effect with respect to glare prevention and cut-off angle control of the light effect. Thus, in an embodiment, the adjustable cover is only moveable with respect to the carrier in the direction perpendicular to the direction defined by the shortest distance between the third side and the fourth side, whereby said perpendicular direction is the direction defined by the shortest distance between the first side and the second side; and, the at least one light source comprises two LED strips; whereby the first LED strip is located on the first face and the second LED strip on the second face of the elongated carrier; and, the light effect originating from the LED strips on the first and second face is controlled simultaneously by the positioning of the adjustable cover with respect to the elongated carrier; and, the shortest distance between the third face and the fourth face is equal to or smaller than four times the width of the first LED strip, wherein the width of the first LED strip is defined by the shortest direction between the third side and the fourth side, and wherein the largest LED strip is defined as the LED strip having the largest width. Alternatively, the LED strips may be identical.

As mentioned before, the adjustable cover is movable relative to the elongated carrier for controlling a light effect originating from the at least one light source. While being in connection with the elongated carrier, the movement of the adjustable cover relative to the elongated carrier is enabled by means of a mechanism. Said mechanism can be guide vanes, bearings, rods, flexible members, screws or other mechanical supports that allow sufficient degrees of freedom to position the adjustable cover with respect to the carrier. This may also include attachment and detachment of the adjustable cover to the elongated carrier. Said movement can be achieved by manual force, an electromotor, piezo-actuators, springs or magnetic force. Thus, in an embodiment, the lighting device comprises an electrically activated moving mechanism for moving the adjustable cover relative to the elongated carrier.

Light effects, including the abovementioned light effects, may be generated by means of a controller that controls the at least one light source and the adjustable cover in the lighting device. Hence, the invention further relates to a system comprising the lighting device according to the invention and a control unit, wherein the control unit is arranged for receiving an input signal containing a command and for sending out a control signal based on the command; and wherein the lighting device comprises an electrically activated moving mechanism for moving the adjustable cover relative to the elongated carrier; and wherein the control signal of the control unit drives the movement of the adjustable cover by activating the electrically activated moving mechanism; and/or wherein the control signal of the control unit drives the at least one light source to generate a light effect.

In an embodiment, the control unit comprises a communication device to communicate with other devices, wherein other devices are selected from the groups consisting of sensors, lighting devices or home electronics. Said communication enables the system comprising the lighting device and the control unit to engage with multiple other devices to create a single or combined light effect. The interplay of devices, preferable lighting devices, enables for more functional and decorative light applications to be generated.

It also facilitates the prevention of glare by communicating with other devices which are able to provide information on the prevention of glare, for example the positioning of the lighting device, the positioning of the elongated carrier with respect to the surface, the current positioning of the adjustable cover with respect to the elongated carrier, the presence of observers in an environment, or the light intensity in the environment.

Said control unit may be integrated in the lighting device, or may be separate from the lighting device like a bridge or smart phone, or may partly be integrated in the lighting device while the remaining part is separate from the lighting device.

Said communication with other devices may be by infrared, RF, visible light communication, Bluetooth, Wi-Fi, ZigBee, or a wired connection. These devices may include, but are not limited to, remote controls, screens, televisions, computers, lighting devices, smartphones, sensors, or audio-devices.

Said control unit, through which communication is enabled between the lighting device and other devices, can for example communicate with sensors related to the positioning of the lighting device. These sensors may for example be cameras, light intensity sensors, electromagnetic proximity sensors or ultrasonic proximity sensors. Said sensors may also be separate from the lighting device as a standalone unit, or be part of the elongated carrier of the lighting device. In an embodiment, a control unit drives the adjustable cover relative to the carrier, wherein the control unit comprises a communication device to communicate with a proximity sensor, which is able to detect, when the lighting device is placed on a surface that is bound between a floor and a ceiling, the distance of the lighting device to the floor and ceiling.

BRIEF DESCRIPTION OF THE DRAWINGS

FIG. 2A and FIG. 2B both depict schematically the prevention of glare by the positioning of the lighting device with respect to the surface, wherein FIG. 2A depicts the situation in which glare is perceived by two out of three observers, while FIG. 2B depicts the situation in which glare is prevented for all three out of three said observers.

DETAILED DESCRIPTION OF THE EMBODIMENTS

Figure 1A:
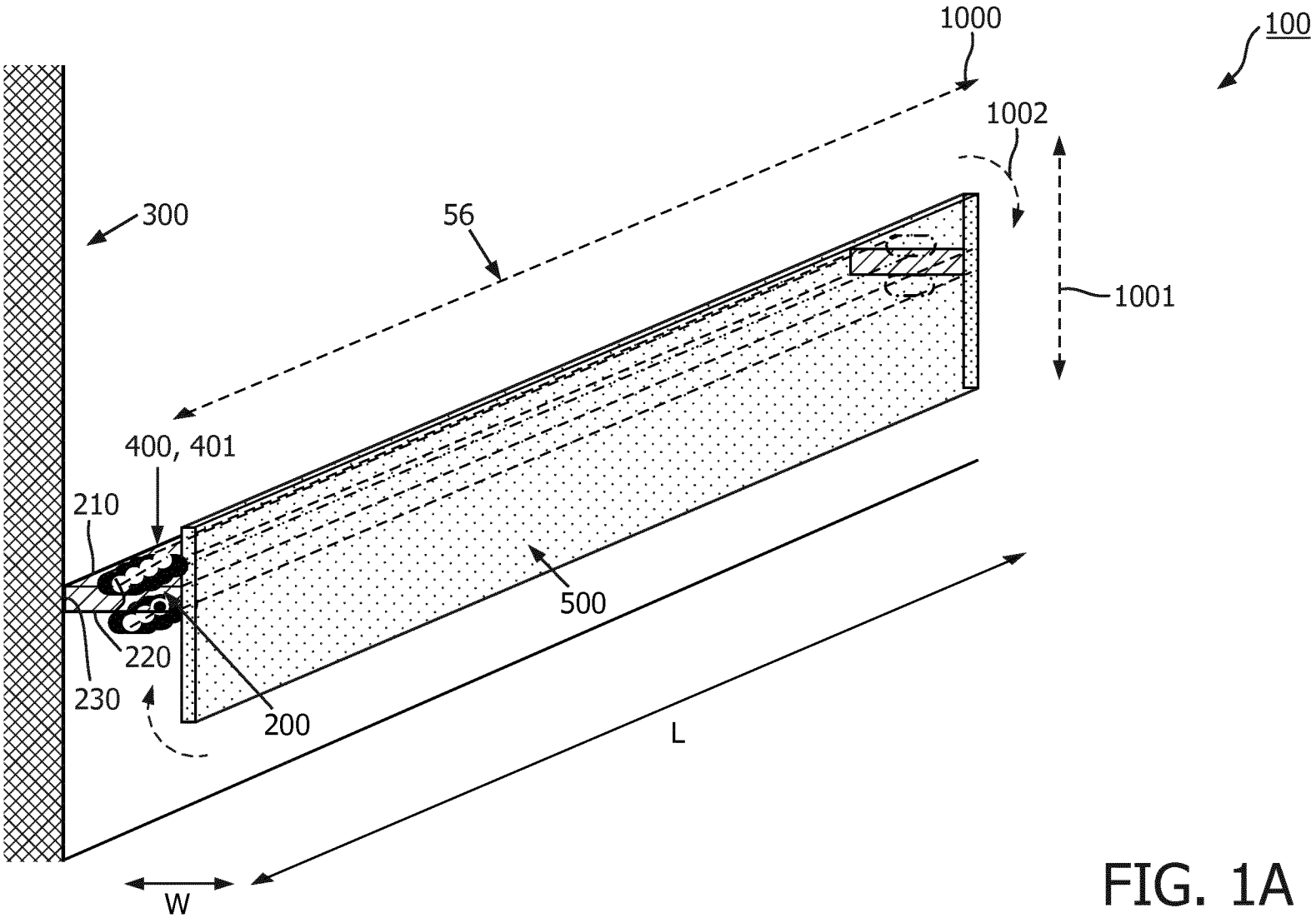
FIG. 1A depicts schematically and in perspective view, by non-limiting example, an embodiment of a lighting device comprising a surface-mountable elongated carrier for positioning relative to a surface, at least one light source, and an adjustable cover.
Figure 1B:
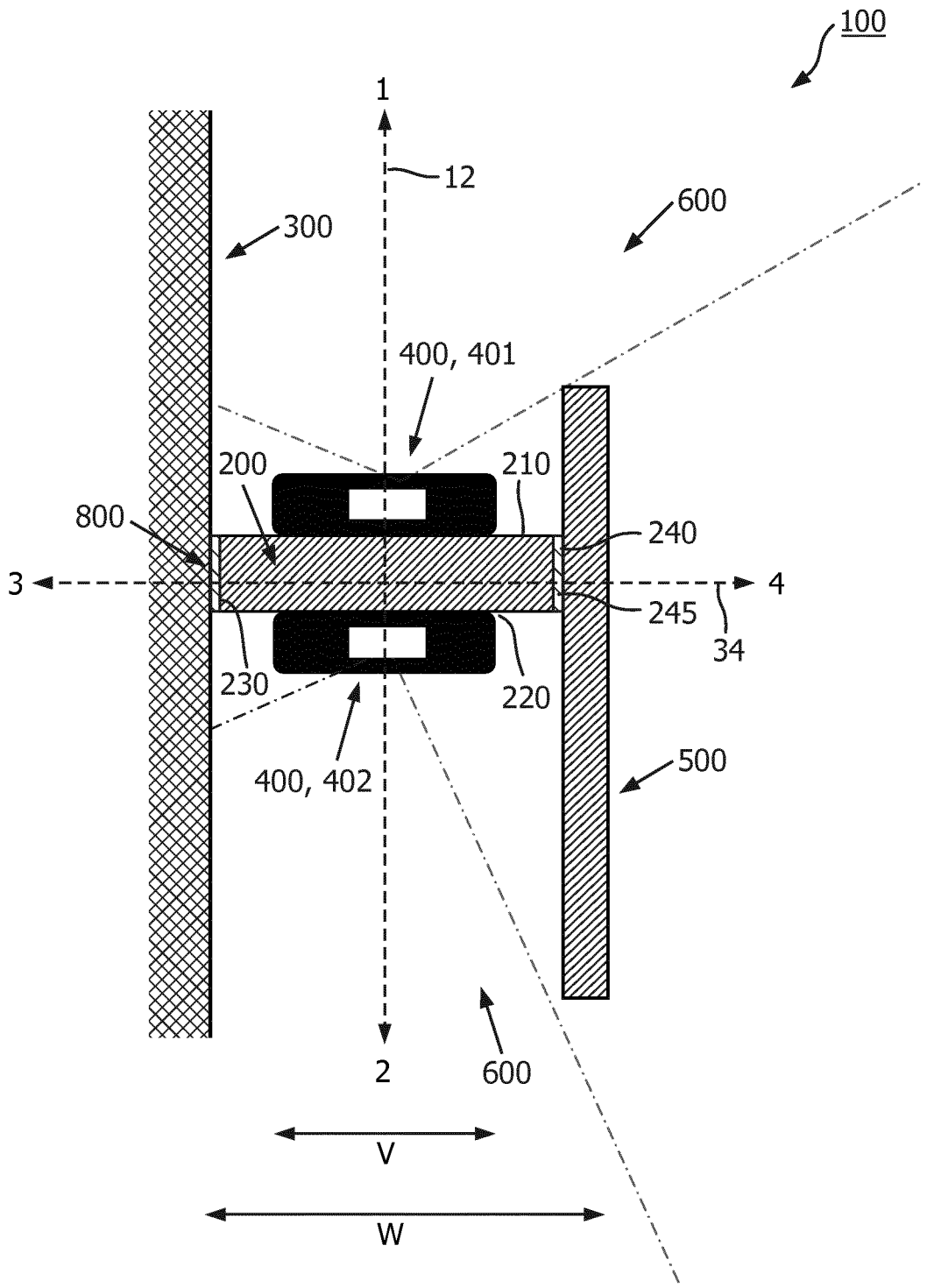
FIG. 1B depicts schematically and in cross-section, by non-limiting example, an embodiment of a lighting device comprising a surface-mountable elongated carrier for positioning relative to a surface, at least one light source, and an adjustable cover.

FIGS. 1A and 1B depict schematically, by non-limiting example, an embodiment of a lighting device 100 comprising a surface-mountable elongated carrier 200 for positioning relative to a surface 300, at least one light source 400, and an adjustable cover 500. Said embodiment is depicted in perspective in figure 1A and in a side view in FIG. 1B.

Referring to the embodiment disclosed in FIG. 1A-B, the surface-mountable elongated carrier 200 is a rectangular profile mounted to the surface 300. The rectangular profile is a single extruded piece with an I shape. Alternatively, the elongated carrier is injected molded. Alternatively, the surface-mountable elongated carrier 200 may have another fixed profile shape, which is extruded uniformly in the elongated direction (56), like for example a I profile, L-shaped profile, V-shaped profile, round or elliptical. The surface-mountable elongated carrier 200 may also be a hollow profile shape comprising a cavity, which for example may be used to accommodate hardware which enable the functioning of the lighting device 100.

Said surface-mountable elongated carrier 200 has an elongated form. As mentioned before, the term elongated means that the length of the carrier 200 of the lighting device 100, also referred to as length L in FIG. 1A, in the direction perpendicular to the direction 34 defined by the shortest distance between the third side 3 and the fourth side 4 (see FIG. 1B), and perpendicular to the direction 12 defined by the shortest distance between the first side 1 and second side 2 is at least four times, preferably at least twelve times larger than the distance defined by the shortest distance between third side 3 and the fourth side 4, also referred to as width W in FIG. 1A-B. The embodiment in FIG. 1A-B depicts schematically a length L eight times larger than the width W.

Still referring to the embodiment disclosed in FIG. 1A-B, the elongated carrier 200 further comprises a third face 230 on a third side 3, which faces the surface 300 to which the elongated carrier 200 is positioned to. In said embodiment the elongated carrier 200 is also mounted to said surface 300 by means of adhesive force, i.e. glue 800. The elongated carrier 200 may alternatively be mounted to this surface 300 by means of other adhesive force like double sided adhesive tape, Velcro, or by means of magnetic force in case of a magnetic surface.

Still referring to the embodiment disclosed in FIG. 1A-B, the elongated carrier 200 further comprises opposite to each other a first face 210 on a first side 1 and a second face 220 on a second side 2. Said sides are best schematically depicted in the side view in FIG. 1B. At least one light source 400 is located on the first 210 and second face 220. In said embodiment the at least one light source 400 is a first LED strip 401 on the first face 210 and a second LED strip 402 on the second face 220. Alternatively, the at least one light source 400 can be another type of light source 400, like for example aspot light, LED or OLED.

In the embodiment depicted in FIG. 1A-B, the shortest distance between the third face 230 and the fourth face 240 is smaller than four times the width of the largest light source 400 present in the lighting device 100, wherein the width of the largest light source 400 is defined by the shortest direction between the third side 3 and the fourth side 4, and wherein the largest light source 400 is defined as the light source 400 having the largest width. Width of largest light source is indicated with reference V in FIG. 1B. To be more specific, the embodiment in FIG. 1A-B depicts a lighting device 100 in which the shortest distance between the third side 3 and the fourth side 4 is one and halve times the width of the largest light source 400 present in the lighting device 100, which is the first 401 or second LED strip 402. As LED strips are semiconductor lighting devices, the width of a LED strip can be made sufficiently small, which subsequently enables the lighting device 100 of this application to be a compact surface-mountable device.

Still referring to the embodiment disclosed in FIG. 1A-B, the adjustable cover 500 is in connection with the elongated carrier 200 on a fourth side 4 opposite to the third side 3, and wherein the adjustable cover 500 is movable relative to the elongated carrier 200 for controlling a light effect 600 originating from the at least one light source 400. In said embodiment the adjustable cover 500 is in connection with the elongated carrier 200 by means of magnets 245. As the adjustable cover 500 is movable relative to the elongated carrier 200, the light effect 600 is controlled, as well as the perception of glare, which is caused by the at least one light source 400 and the positioning of the carrier 200 relative to the surface 300.

Still referring to the embodiment disclosed in FIG. 1A-B, the adjustable cover 500 is moveable in a direction perpendicular to the direction 34 defined by the shortest distance between the third side 3 and fourth side 4. The movement of the adjustable cover 500 is in this embodiment limited to translations 1000, 1001, rotation 1002, and combination thereof in the plane perpendicular to the direction 34 defined by the shortest distance between the third 3 and fourth side 4. Still referring to FIG. 1A-B, yet in another embodiment, the adjustable cover 500 is only moveable in the direction perpendicular to the direction 34 defined by the shortest distance between the third side 3 and the fourth side 4, whereby said perpendicular direction is the direction 12 defined by the shortest distance between the first side 1 and the second side 2. The movement of the adjustable cover 500 is in this embodiment limited to translation 1001 in the direction 12 defined by the shortest distance between the first side 1 and the second side 2. Hence, depending on the requirements for controlling the light effect 600 and the perception of glare, the adjustable cover 500 is moveable with respect to the elongated carrier 200 in multiple degrees of freedom.

Figure 2B:
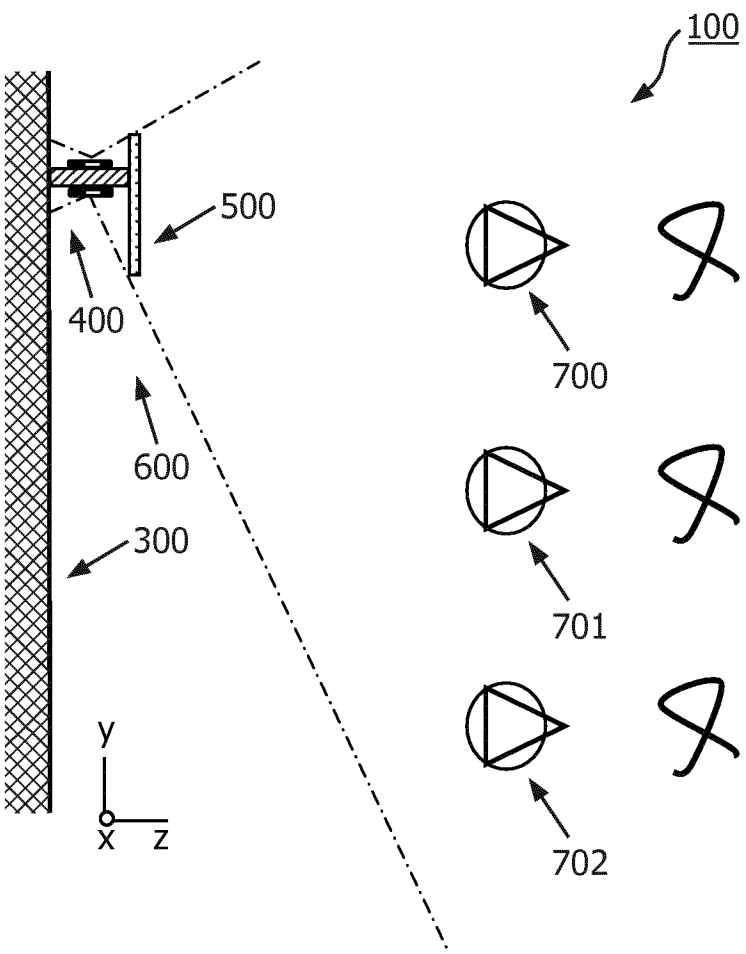
Figure 2A:
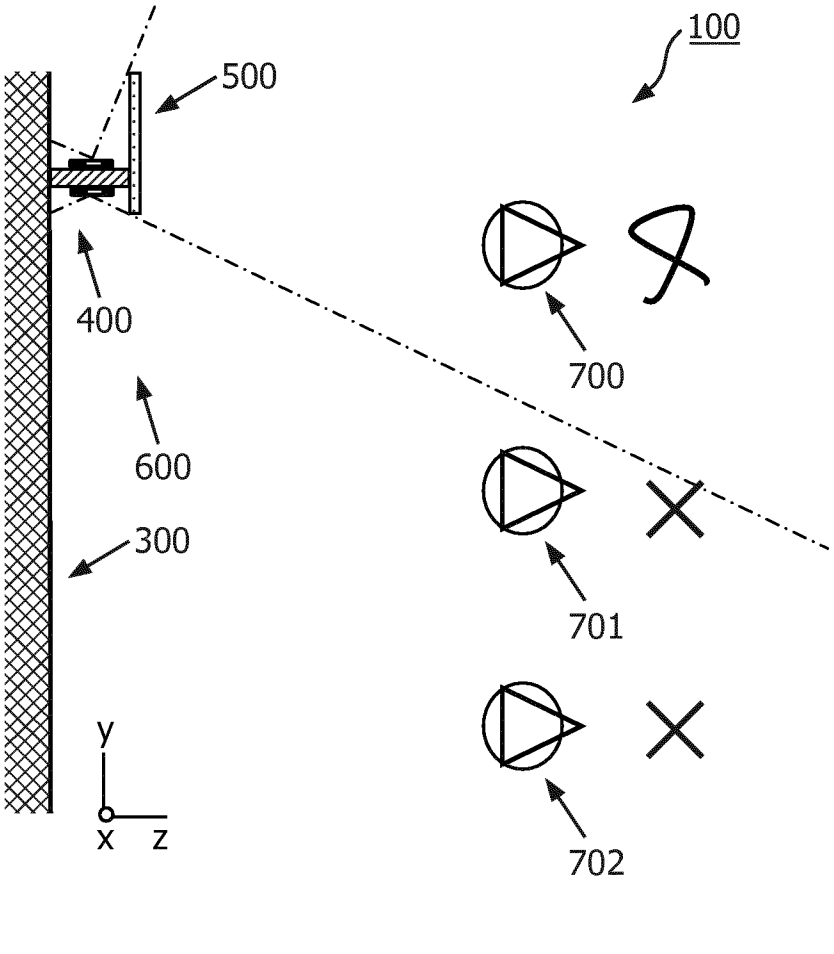

As mentioned before, the lighting device 100 is positioned relative the surface 300. The lighting device 100 will render a light effect 600 on the surface 300, while the at least one light source 400 will also be a source for glare. The control of the perception of glare is schematically depicted in FIG. 2A-B, in which the embodiment described in FIG. 1A-B is used as a non-limiting example, wherein said perception is being observed by observers 700,701,702 facing the surface 300. The observers 700,701,702 are depicted as an eye symbol which are able to receive the rays of light emitted by the at least one light source 400. In FIG. 2A-B the lighting device 100 is mounted on the surface 300, wherein the elongated carrier 200 is extended with its elongated direction in the x-direction (of the coordinate system shown in the figure). The observers 700,701,702 are observing the lighting device 100 while being positioned at various locations on the y-axis, and while being positioned below the y-coordinate on which lighting device 100 is located, see FIG. 2A-B; Hereby, observer 700 is positioned on the y-coordinate closest to the lighting device 100, followed by observer 701 on a lower y-coordinate, followed by observer 702 on a lower y-coordinate than observer 701. Alternatively, the observers 700,701,702 may be observing the lighting device 100 while being positioned at various locations on the y-axis, and while being above the y-coordinate on which the lighting device 100 is located (not shown). Depending on the positioning of the lighting device 100 relative to the surface 300, the perception of glare is controlled by the adjustable cover 500. FIG. 2A depicts the situation that glare occurs due to the positioning of the lighting device 100. Here, observer 701 and 702 experience glare, while observer 700 is prevented from glare. In such a situation, FIG. 2B depicts the case that the adjustable cover 500 is subsequently moved relative to the elongated carrier 200 to control the light effect 600 and control the perception of glare caused by the at least one light source 400. Hence, in FIG. 2B glare is prevented. Now observers 701 and 702 are also prevented from the perception of glare.

Figure 3:
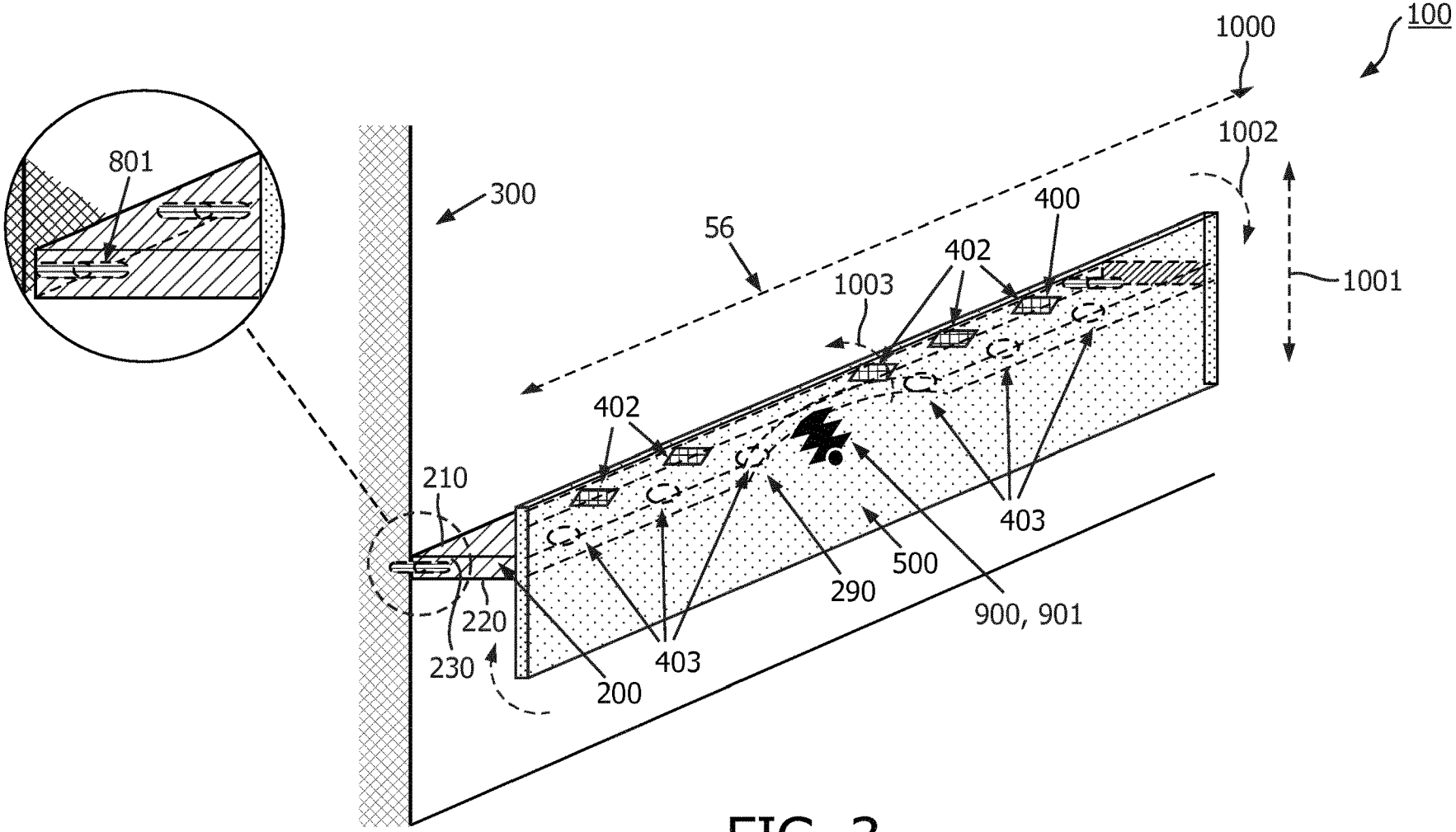
FIG. 3 depicts schematically an embodiment of the lighting device.

FIG. 3 depicts schematically, by non-limiting example, an embodiment of a lighting device 100 according to the invention. The surface-mountable elongated carrier 200 is a rectangular profile, which has a cross-sectional shape (i.e. the end face of the elongated carrier) that changes along the elongated direction 56, as there is an elliptical shaped narrowing 290 present in the construction to facilitate the moving mechanism 900 of the adjustable cover 500. The narrowing of the elongated carrier 200 along the elongated direction might also be narrowing or expanding according to a shape other than elliptic. Alternatively, said cross-sectional shape may be partly discontinuous along the elongated direction, i.e. the elongated carrier may have gaps for enabling an opening between the first face 210 and second face 220. Such discontinuities or gaps may reduce weight of the elongated carrier, may allow access from the first face of the elongated carrier to the second face, or may facilitate convection to cool the at least one light source.

Referring to the embodiment depicted in FIG. 3, the surface mountable carrier 200 is mounted to the surface 300 with tight-fitted plugs 801 which mount the elongated carrier 200 to the surface 300 by connecting holes in the surface 300 and the carrier 200 in which they are fitted. Alternatively, other mechanical means of mounting the elongated carrier 200 might be applied like for example screws, wherein the screws are made accessible through an opening in the elongated carrier 200.

Still referring to the embodiment disclosed in FIG. 3, the elongated carrier 200 further comprises opposite to each other a first face 210 on a first side and a second face 220 on a second side. The first face 210 comprises an array of individual LED light sources 402, which are positioned consecutively on the first face 210 in a row along the elongated direction 56 of the elongated carrier 200. The second side 2 comprises an array of individual spot lights 403, which are positioned consecutively on the second face 220 in a row along the elongated direction 56 of the elongated carrier 200. Alternatively, said light sources 402, 403 can for example be positioned in other non-consecutive arrangements like clustered on one side or along a patterned line.

Still referring to the embodiment disclosed in FIG. 3, the adjustable cover 500 is in connection with the elongated carrier 200 and is arranged at a fourth side opposite to the third side, and wherein the adjustable cover 500 is movable relative to the elongated carrier 200 for controlling a light effect originating from the at least one light source 400. The movement of the adjustable cover 500 is enabled by the movement mechanism 900. The movement mechanism 900 comprises a flexible straw like plastic tube 901, with sufficient rigidity to hold the adjustable cover 500 in place, but with enough flexibility to ensure the movement of the adjustable cover 500. Alternatively, the straw like plastic tube 901 can be a soft metal like aluminum or copper. Due to this movement mechanism 900, the movement of the adjustable cover 500 is enabled in all possible degrees of freedom, which is translation 1000, 1001, rotation 1002 and tilting 1003 relative to the elongated carrier 200. The movement is hereby driven by manual force. Alternatively, the movement mechanism depicted in the embodiment of FIG. 3 might be electrically driven by for example an electromotor or piezo actuators.

Figure 4:
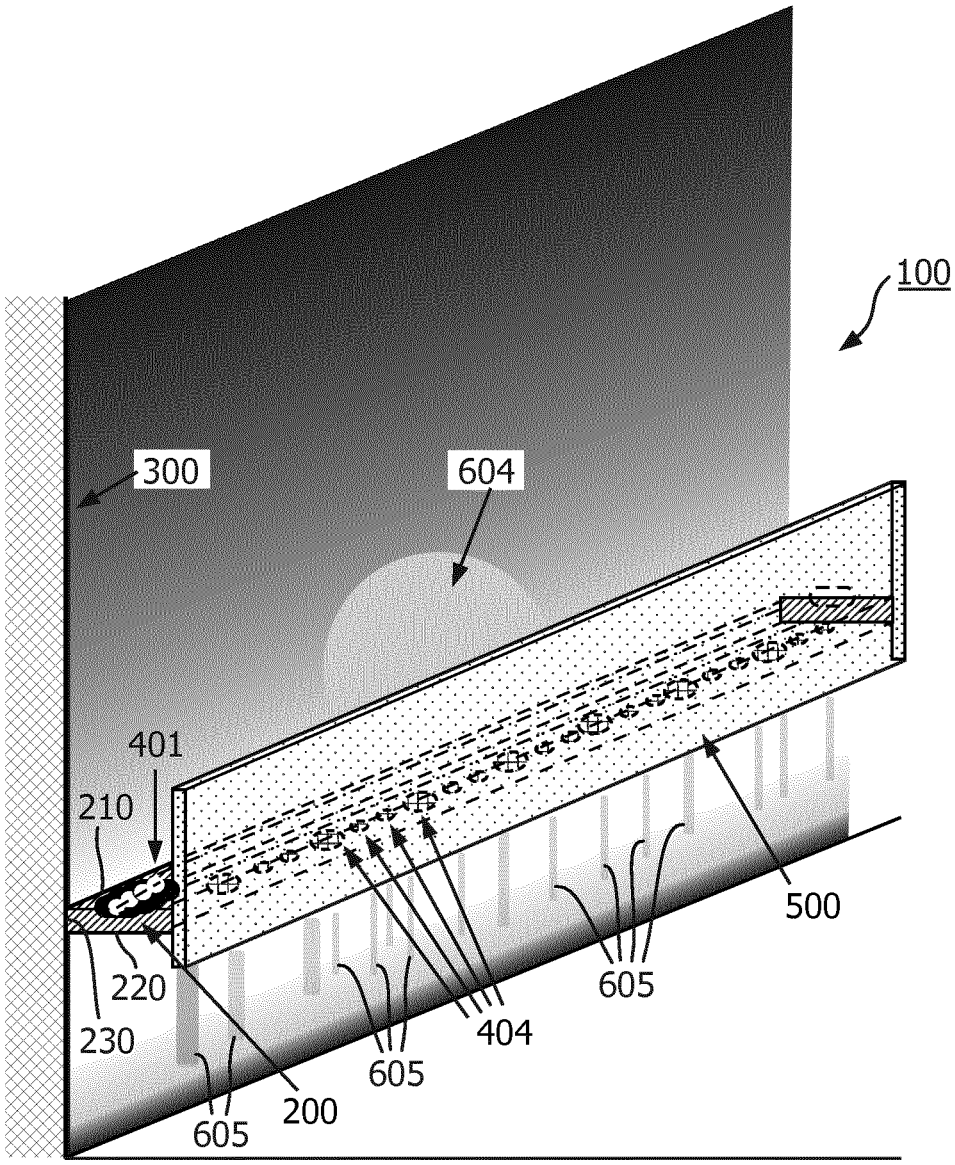
FIG. 4 depicts schematically an embodiment of the lighting device showing an example of a light effect on a surface.

FIG. 4 depicts schematically an embodiment, partly similar to the embodiment disclosed in FIG. 1A-B, but wherein the at least one light source 400 on the second face 220 is now a plurality of miniature LED spots with varying diameter 404. The miniature LED spots 404 are positioned in a sequence wherein two (smaller) LED spots are present between two consecutive LED spots with larger diameter. This arrangement will enable a light effect 605 mimicking rain on the surface 300 on the second side 2 to which the lighting device 100 is positioned to. Alternative light effects might also be generated, for example waving wheats, ocean waves or fireflies. The LED strip 401 on the first face 210 of the elongated carrier 200 is able to project a light effect 604 on the surface 300 mimicking the rise and set of the sun. While the lighting device 100 is able to generate such light effects, the adjustable cover 500 is positioned such that the effect of glare is prevented during these effects. Although said light effects are specific for each scene, the overall effect of the lighting device relates to a functional surface-washing effect, as the lighting device 100 is positioned relative to the surface 300.

Figure 5:
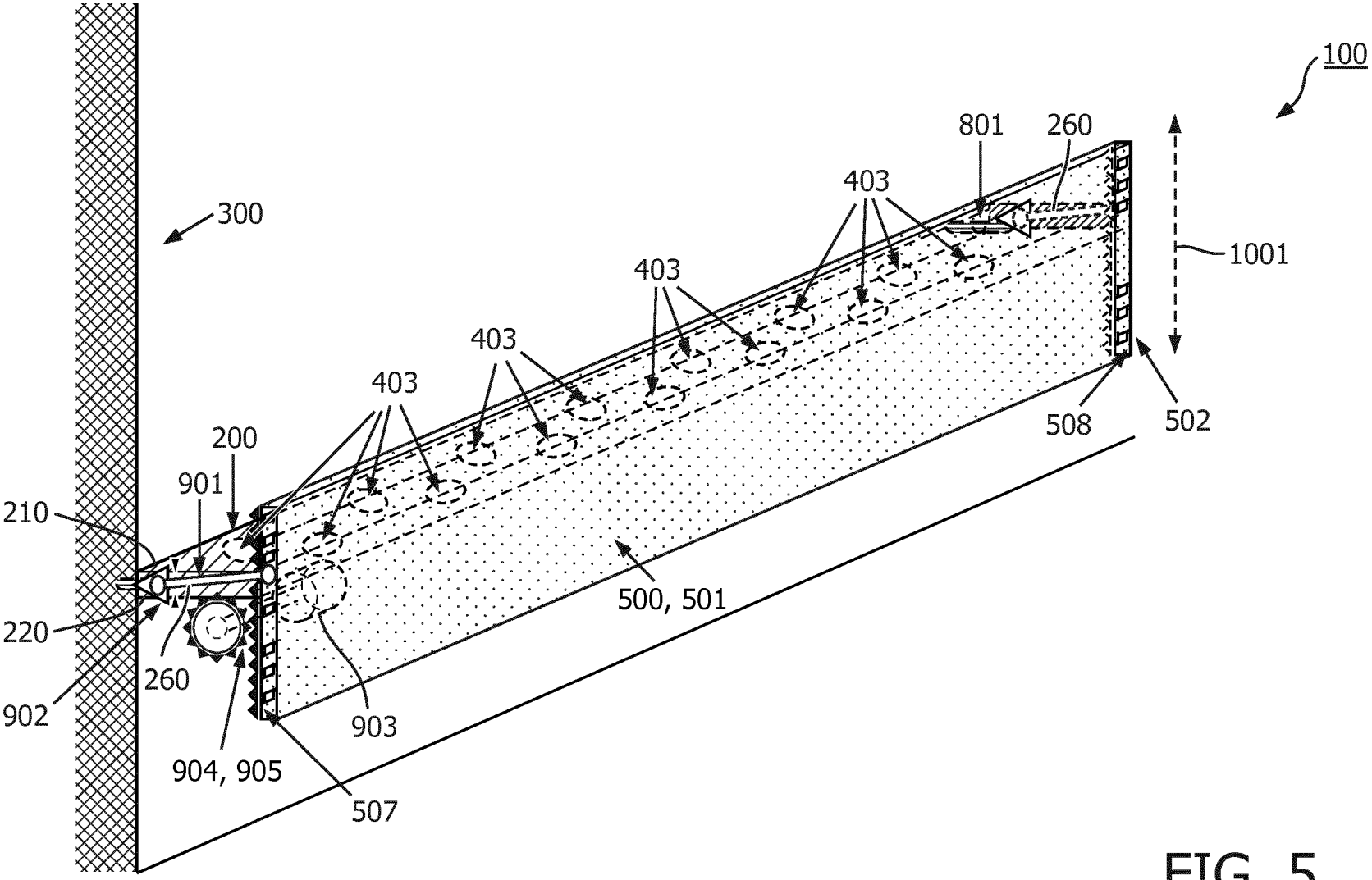
FIG. 5 depicts schematically an embodiment of the lighting device comprising amongst others an electrically activated moving mechanism for moving the adjustable cover.

FIG. 5 depicts schematically, an embodiment of a lighting device 100 according to the invention. The at least one light source 400 comprises spots 403, which are located consecutively in a row on both the first face 210 and on the second face 220, whereby the spots 403 on the first face 210 and on the second face 220 are in an alternating pattern with respect to each other. This alternating pattern may facilitate cooling of the spots 403, while the elongated carrier 200 may serve as a heat sink to these spots 403. Alternatively, in case multiple light sources are present, the at least one light source may be positioned in a pattern other than alternating. For example, clustered light sources along the elongated direction of the carrier 200, a higher density of light sources at the center or ends of the elongated carrier 200, light sources on the first side being located at the center of the elongated carrier 200, while light sources on the second side being located at the ends of the elongated carrier 200.

Referring to FIG. 5, The surface-mountable elongated carrier 200 is a rectangular profile, which is mounted to the surface 300 by means of tight-fitted plugs 801 which mount the elongated carrier 200 to the surface 300 by connecting holes in the surface 300 and the carrier 200 in which they are fitted.

Still referring to the embodiment depicted in FIG. 5, the adjustable cover 500 is made out of a translucent material 501. The adjustable cover 500 comprises LED light sources 502 attached to the end faces 507, 508 of the adjustable cover, which are partly enclosing the adjustable cover 500, whereby the LED light sources are facing inwards into the adjustable cover, such that the translucent adjustable cover 500,501 serves as a diffuse light guide for the light emitted from said LED light sources 502. Alternatively, the LED light sources 502 might be attached to the other faces of the adjustable cover 500. In this way, the adjustable cover 500 will emit diffuse light in the color of the LED light sources 502, which enables the adjustable cover 500 to have a color corresponding to the light effects of the lighting device 100.

Still referring to the embodiment disclosed in FIG. 5, the adjustable cover 500 is moveable in a direction perpendicular to the direction defined by the shortest distance between the third side and fourth side. The movement of the adjustable cover 500 is in this embodiment limited to translation 1001 in the plane perpendicular to the direction defined by the shortest distance between the third and fourth side. The adjustable cover 500 is furthermore in connection with the elongated carrier 200 by means of two rods 901 on each of the end faces 250,260 of the elongated carrier 200 not corresponding to the first, second, third or fourth face. Said rods 901 are housed in a bearing 902, which enables said movement of the adjustable cover 500, while holding the adjustable cover 500 in place relative to the elongated carrier 200. The bearing 902 may provide sufficient tolerance for the rods 901 to move while holding the adjustable cover 500, such that the adjustable cover 500 may translate in said direction 1001 to which it is limited to. Alternatively, the rods 901 may be able to slightly extend length, like for example telescopic rods. In this embodiment, the movement of the adjustable cover 500 is electrically driven by an electromotor 903, which may be placed on the second face 220 of the elongated carrier 200 and which may comprise a gear (segment) 904 to transfer force to teeth or rack 905 on the adjustable cover 500 for moving the adjustable cover 500. Alternatively, other mechanical mechanisms for transfer of movement, known to the person skilled in the art, may be selected to drive the adjustable cover 500 with the electromotor 903. Alternatively, next to the electromotor, the driving element may for example be piezo-actuators, linear motors or electromagnets. The position of the motor and the manner in which the motor moves the adjustable cover 500 is not relevant as long as the adjustable cover 500 can be moved with respect to the elongated carrier 200.

Figure 6:
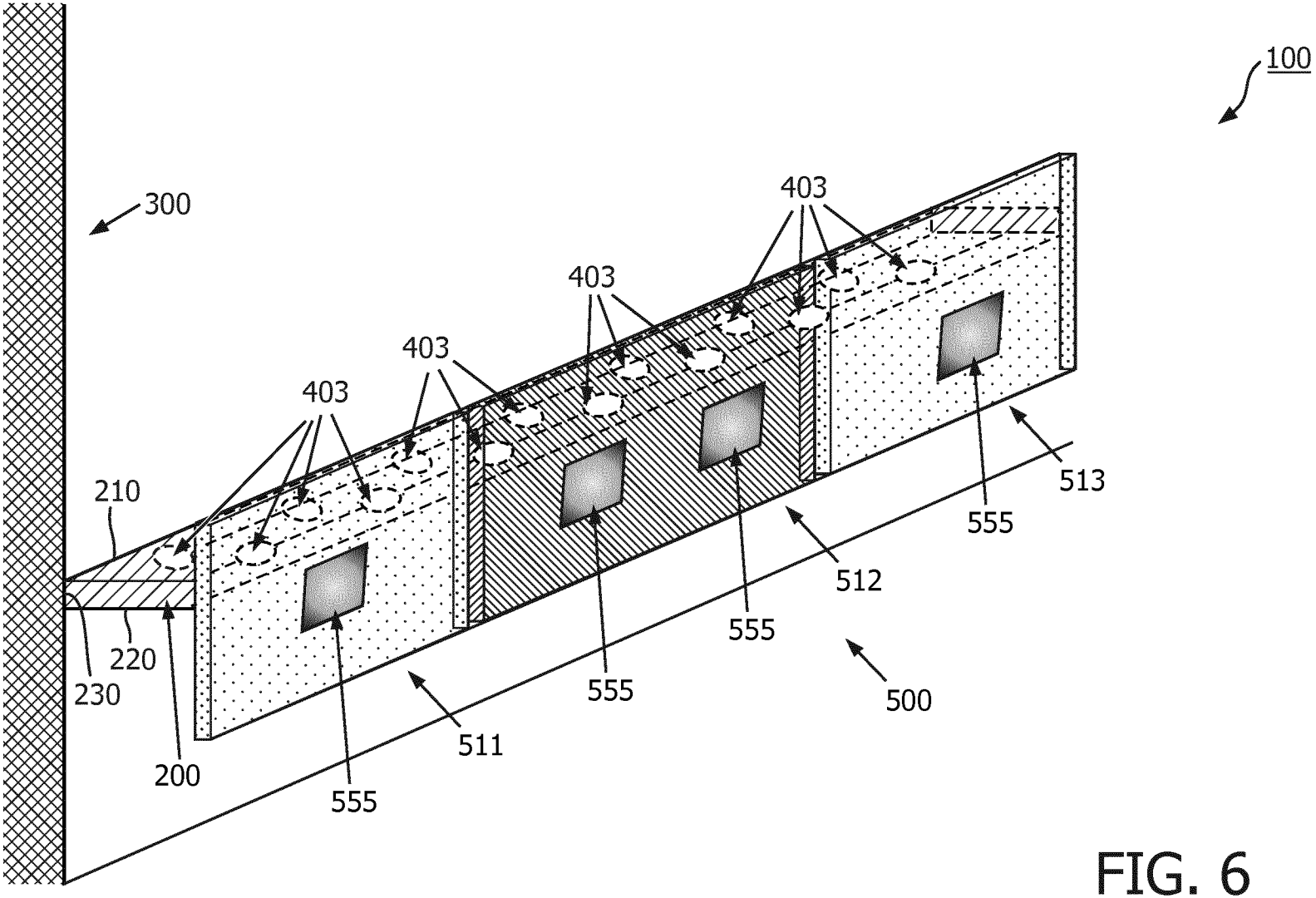
FIG. 6 depicts schematically an embodiment of the lighting device.

FIG. 6 depicts schematically an embodiment, partly similar to the embodiment disclosed in FIG. 1A-B, but wherein the at least one light source 400 is a plurality of point sources of light 403, and wherein the adjustable cover 500 consists separately out of a first cover 511, a second cover 512 and a third cover 513, whereby the three covers are located consecutively along the elongated direction of the elongated carrier 200, and whereby the three covers 511,512,513 are adjustable individually to determine the overall positioning of the adjustable cover 500 with respect to the carrier 200. Said three covers have furthermore a window 555 made out of a translucent material, while the remaining part of the adjustable cover 500 is opaque. The translucent windows 555 enables a diffuse light to be emitted to the fourth side of the lighting device 100, such that not only a surface washing light effect is achieved, but also the side opposite to the wall is illuminated with diffuse light. The translucent windows may alternatively be used to enable optical access to possible receivers and transmitters located on the elongated carrier. Alternatively, the adjustable cover 500 may for example consist separately out of a first cover and a second cover, of which the first cover is covering the light sources on the first side and the second cover is covering the light sources on the second side, whereby the at least first cover and second cover are adjustable individually to determine the overall positioning of the adjustable cover 500 with respect to the carrier 200. Or alternatively, the adjustable cover 500 is for example made out of a flexible material, such that the flexible adjustable cover is locally deformable to facilitate local control of the light effect.

Figure 7:
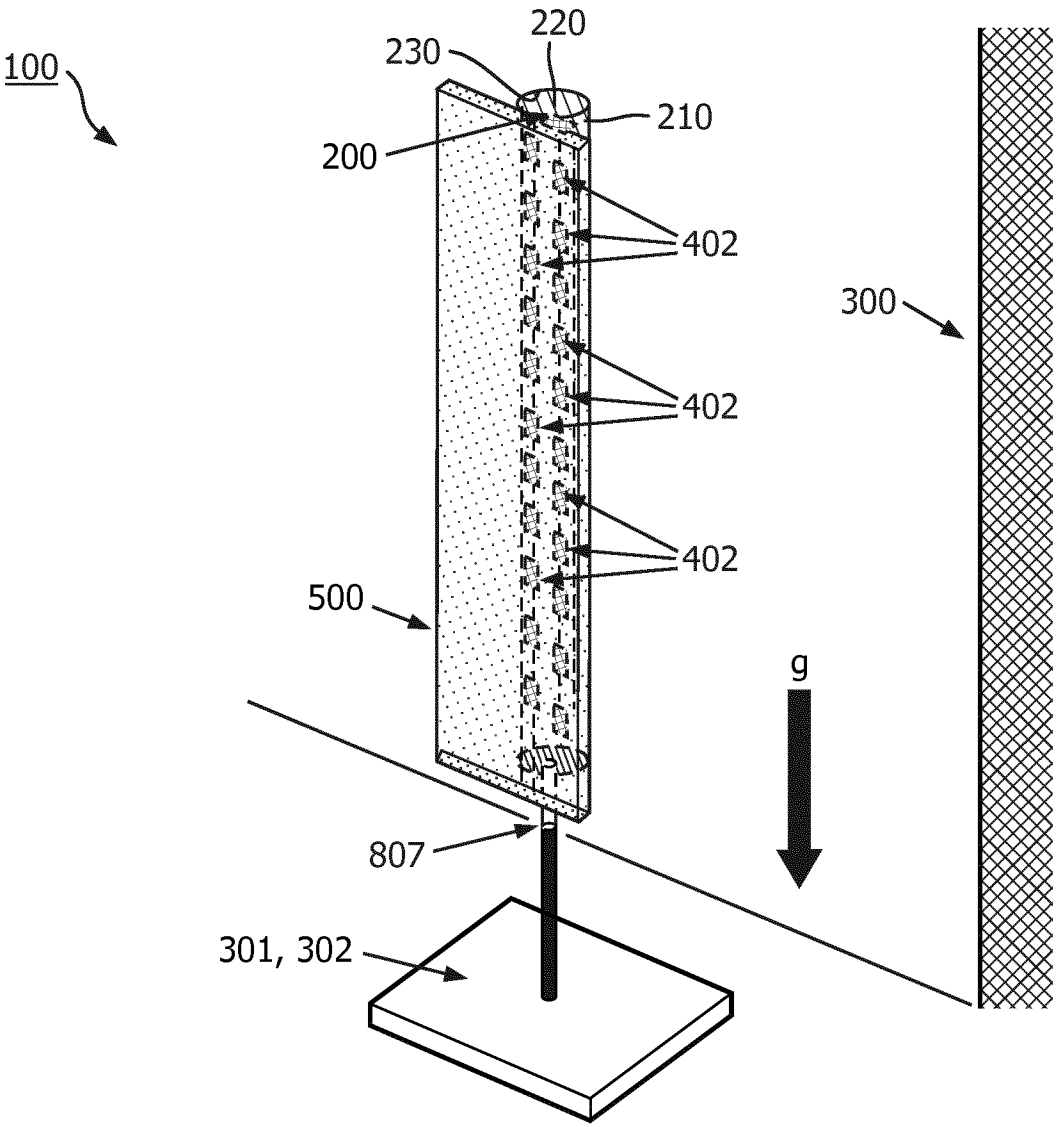
FIG. 7 depicts schematically an embodiment of the lighting device, wherein the surface to which the lighting device is mounted is not similar to the surface towards which the lighting device is positioned to, and FIG. 8 depicts schematically an embodiment of a system comprising a control unit and a lighting device according to the invention.

FIG. 7 depicts schematically an embodiment of a lighting device 100 according to the invention, partly similar to the embodiment disclosed in FIG. 1A-B, but wherein the elongated carrier 200 has an elliptical cross sectional shape and the at least one light source 400 comprises an array of LED's 402 located on the first face 210 and second face 220 of the elongated carrier 200. An arrow with symbol g is depicted in FIG. 7 to indicate the gravitational direction. The lighting device 100 of the embodiment depicted in FIG. 7 is moreover mounted to another surface 301 than the surface 300 to which the lighting device 100 is positioned to.

As mentioned before, the surface-mountable elongated carrier 200 is mountable to a surface. The surface 301 to which the lighting device 100 is mounted does not have to be similar to the surface 300 towards which the lighting device 100 is positioned to. The elongated carrier 200 can also be mountable to any other surface suitable for mounting the described lighting device 100. The phrase mountable is in this application not limited to only mechanical means of mounting, but also includes alternatives, like means of mounting comprising gravitational force if the lighting device 100 is supported by a surface without being fixed to the surface. FIG. 7 depicts an embodiment in which the elongated carrier 200 is mounted to an alternative surface 301 by means of a rod 807, which has a baseplate 302 for balance, which sits on a floor. Alternatively, the lighting device may for example be mounted to the ceiling by a hanging construction.

Figure 8:
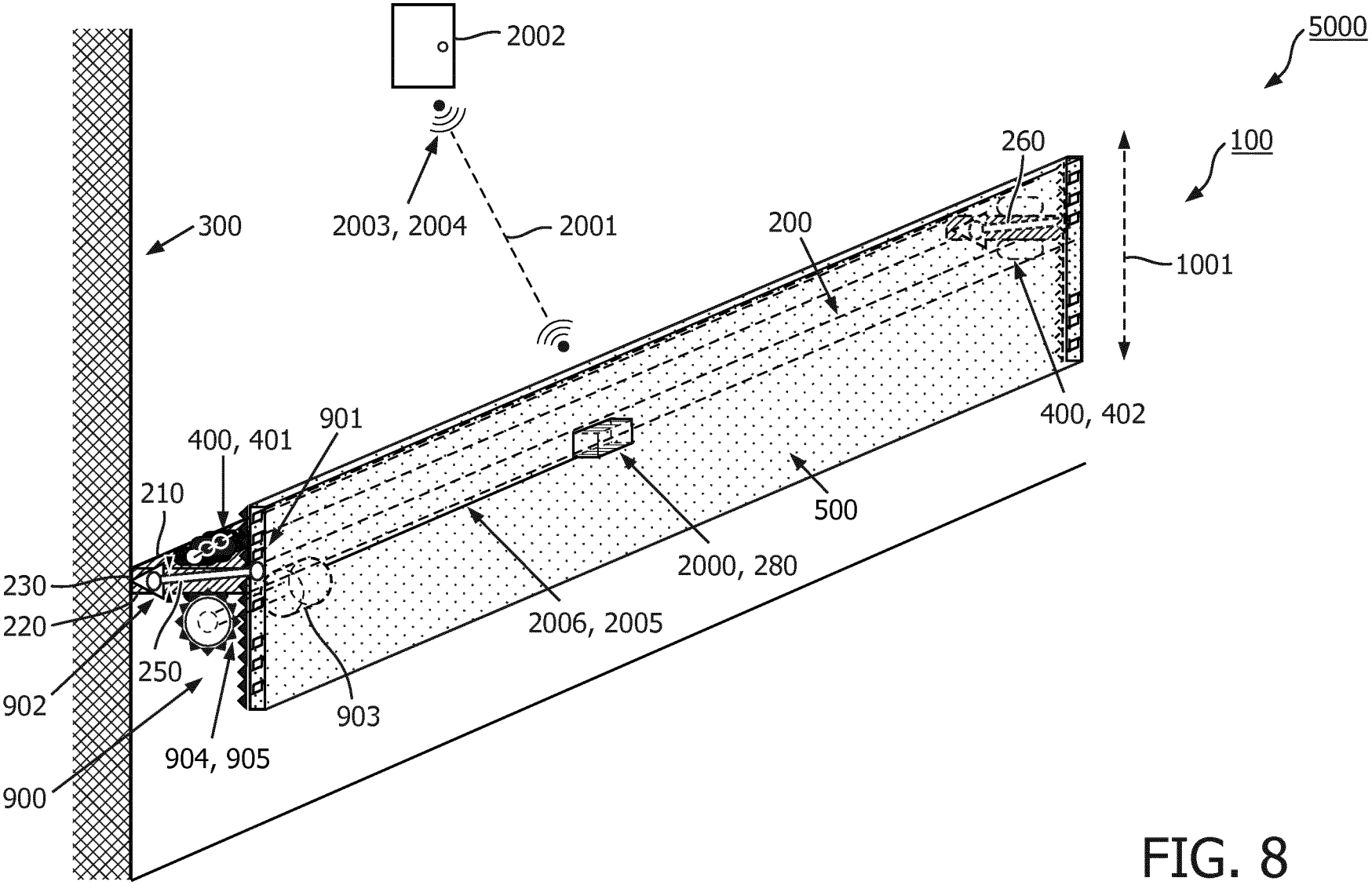

FIG. 8 depicts schematically an embodiment of a system 5000 comprising a control unit 2000 and a lighting device 100 according to the invention.

The lighting device 100 depicted in FIG. 8 is partly similar to the lighting device 100 disclosed in FIG. 1A-B, referring back to FIG. 1A-B, wherein the at least one light source 400 is a first LED strip 401 on the first face 210 and a second LED strip 402 on the second face 220; but wherein the adjustable cover 500 is moveable in a direction perpendicular to the direction defined by the shortest distance between the third side and fourth side. The movement of the adjustable cover 500 is in this embodiment limited to translation 1001 in the plane perpendicular to the direction defined by the shortest distance between the third and fourth side. The adjustable cover 500 is furthermore in connection with the elongated carrier 200 by means of two rods 901 on each of the end faces 250,260 of the elongated carrier 200 not corresponding to the first, second, third or fourth face. Said rods 901 are housed in a bearing 902, which enable said movement of the adjustable cover 500, while holding the adjustable cover 500 in place relative to the elongated carrier 200. In this embodiment, the movement of the adjustable cover 500 is electrically driven by an electromotor 903, which is placed on the second face 220 of the elongated carrier 200 and which comprises a gear (segment) 904 to transfer force to teeth or rack 905 on the adjustable cover 500 for moving the adjustable cover 500. Alternatively, other mechanical mechanisms for transfer of movement, known to the person skilled in the art, may be selected to drive the adjustable cover 500 with the electromotor 903.

Alternatively, next to the electromotor, the driving element may for example be piezo-actuators, linear motors or electromagnets. The position of the motor and the manner in which the motor moves the adjustable cover 500 is not relevant as long as the adjustable cover 500 can be moved with respect to the elongated carrier 200.

Referring to FIG. 8, said control unit 2000 is located in a space 280 within the elongated carrier 200. The control unit 2000 has means to communicate with other devices 2002 by means of Wi-Fi 2001. Alternatively, said communication might for example be by means of infrared, RF, visible light communication, Bluetooth, ZigBee, or a wired connection. The control unit 2000 might alternatively be located partly separate from the lighting device, for example as a bridge or smartphone. In the embodiment of FIG. 8, the control unit 2000 receives an input signal 2003 from another device 2002, for example another lighting device or sensor 2002, containing a command 2004 to adjust the adjustable cover 500. The control unit subsequently sends out a control signal 2005 based on said command by means of a wired connection 2006 to the movement mechanism 900 of the lighting device 100. The control signal 2005 of the control unit 2000 drives the movement 1001 of the adjustable cover 500 by activating the electrically activated moving mechanism 900 which comprises an electromotor 903, rods 902, gear (segment), 904, teeth or rack 905, and bearings 902. Alternatively, the control unit can for example drive the LED strips 401, 402 present on the faces 210,220 of the carrier 200 of the lighting device 100 for generating a light effect. As the sensor 2002 is a proximity sensor to detect the location of the lighting device 100 on the surface 300 and detect the location of the lighting device 100 with respect to an observer, the input signal 2003 will lead to the movement of the adjustable cover 500, such that the perception of glare is prevented.

Figure 9:
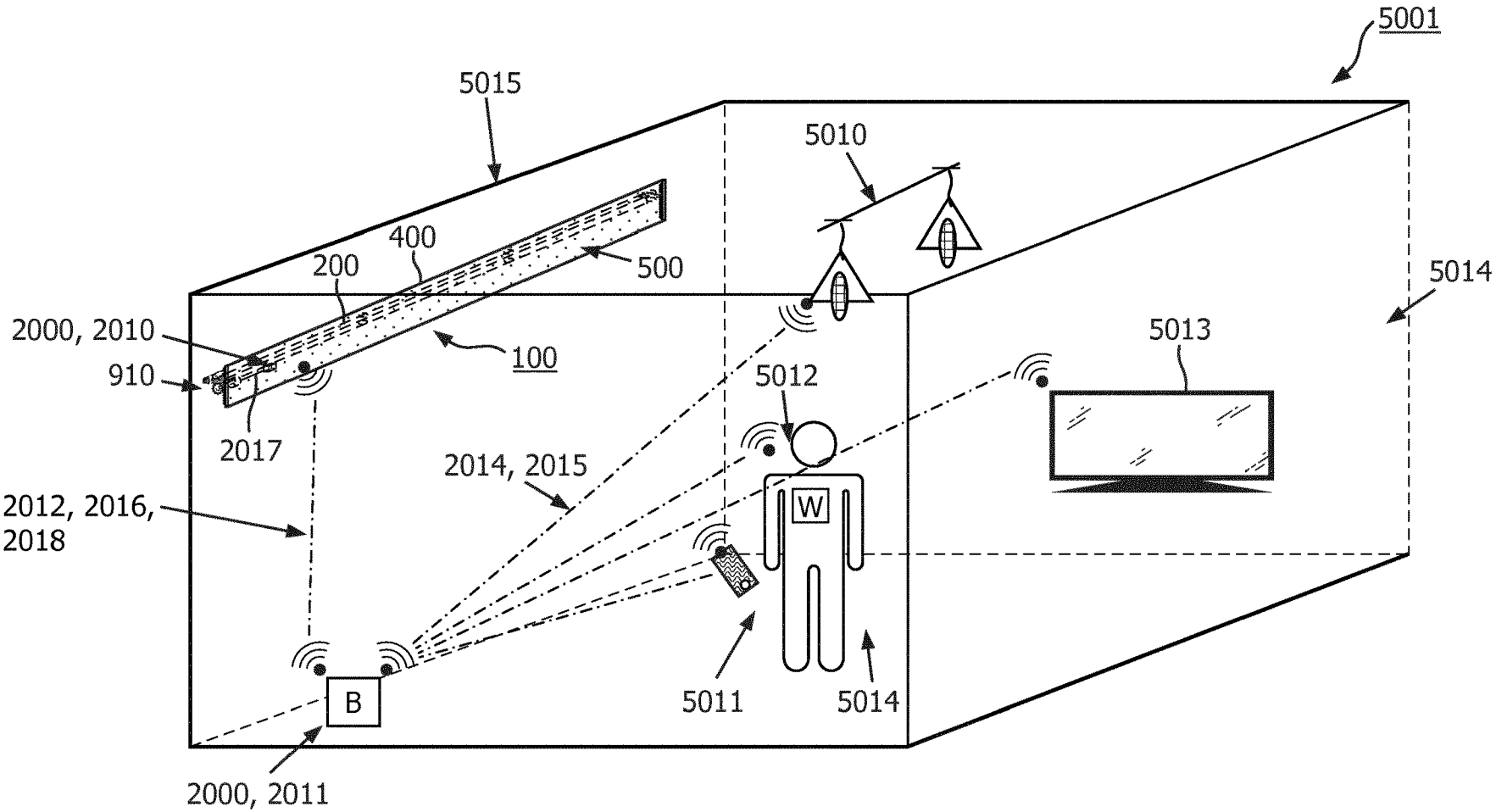
FIG. 9 depicts schematically an embodiment of a system comprising a control unit and a lighting device according to the invention, wherein the control unit comprises a communication device to communicate with other devices, wherein the other devices comprises a lighting device, a smartphone, a smart wearable and a smart television.

FIG. 9 depicts schematically an embodiment of a system 5001 comprising a control unit 2000 and a lighting device 100 according to the invention, wherein the control unit 2000 comprises a communication device 2011 to communicate with other devices, wherein the other devices comprise a lighting device 5010, a smartphone 5011, a smart wearable 5012 and a smart television 5013. Here, the lighting device 100 is located within a room 5014 and positioned relative to a wall 5015.

Referring to FIG. 9: The lighting device 100 depicted in FIG. 9 is partly similar to the lighting device 100 disclosed in FIG. 1A-B, referring back to FIG. 1A-B, wherein the at least one light source 400 is a first LED strip 401 on the first face 210 and a second LED strip 402 on the second face 220; but wherein the adjustable cover 500 is moveable in a direction perpendicular to the direction defined by the shortest distance between the third side and fourth side. The movement of the adjustable cover 500 is in this embodiment limited to translation in the plane perpendicular to the direction defined by the shortest distance between the third and fourth side. The adjustable cover 500 is furthermore in connection with the elongated carrier 200 by means of two rods on each of the end faces of the elongated carrier 200 not corresponding to the first, second, third or fourth face. Said rods are housed in a bearing, which enable said movement of the adjustable cover 500, while holding the adjustable cover 500 in place relative to the elongated carrier 200. In this embodiment, the movement of the adjustable cover 500 is electrically driven by an electromotor, which may be placed on the second face of the elongated carrier 200 and which may comprise a gear (segment) to transfer force to teeth or rack on the adjustable cover 500 for moving the adjustable cover 500. Alternatively, other mechanical mechanisms for transfer of movement, known to the person skilled in the art, may be selected to drive the adjustable cover 500 with the electromotor. Alternatively, next to the electromotor, the driving element may for example be piezo-actuators, linear motors or electromagnets. The position of the motor and the manner in which the motor moves the adjustable cover 500 is not relevant as long as the adjustable cover 500 can be moved with respect to the elongated carrier 200.

Still referring to FIG. 9, said control unit 2000 comprises a receiver 2010 arranged on the elongated carrier 200 of the lighting device 100 and a bridge 2011 located separate from the lighting device 100 in the room 5014. The receiver 2010 and bridge 2011 are in communication with each other by means of ZigBee 2012. Alternatively, said communication might for example be by means of infrared, RF, visible light communication, Bluetooth or Wi-Fi. The bridge 2011 is furthermore in connection with other devices by means of Wi-Fi, alternatively with for example ZigBee, wherein the other devices comprise a lighting device 5010, a smartphone 5011, a smart wearable 5012 and a smart television 5013. Said other devices 5010, 5011, 5012, 5013 are able to send input signals 2014 to the bridge 2011 of the control unit 2000 of the lighting device 100. The other lighting device 5010 may for example be a luminaire comprising the Philips Hue connected lighting, the smart television 5013 may for example be a Philips Ambilight television. The bridge 2011 of the control unit 2000 is able to process these input signals 2014 from the said other devices 5010, 5011, 5012, 5013. The bridge 2011 of the control unit 2000 is also able to send a control signal 2015 to these other devices 5010, 5011, 5012, 5013; and is able to send a control signal 2018 via the receiver 2010 and wired connection 2017 to the movement mechanism 910 and/or the at least one light source 400 of the lighting device 100 to generate a light effect in the room 5014 based on an interplay between the lighting device 100 and the other devices 5010, 5011, 5012, 5013. Due to relevant information on the activities within the room 5014, the lighting device 100 may provide functional lighting, while the perception of glare is prevented. For example, the smartphone 5011 and smart wearable device 5012 may send input signals 2014 comprising the location of a person 5014 in the room 5014; the smart television 5013 may send input signals 2014 comprising the current use status of the smart television 5013, which may be an indication for the presence of people in the room 5014 or the light intensity and light distribution in the room; the other lighting device 5010 may send the light intensity it emits within the room 5014. Combining and processing the information from these other devices 5010, 5011, 5012, 5013 may enable the lighting device 100 to provide the best possible arrangement of the adjustable cover 500 and the resulting light effect to prevent the perception of glare.

The invention claimed is:

1. A lighting device comprising a surface-mountable elongated carrier for positioning relative to a surface, at least one light source, and an adjustable cover;

wherein the elongated carrier comprises opposite to each other, a first face on a first side and a second face on a second side, the at least one light source is located on the first and second face; and wherein the elongated carrier comprises a third face on a third side for facing the surface in mounted position; and wherein the adjustable cover is in connection with the carrier and is positioned on a fourth side of the carrier opposite to the third side, and wherein the adjustable cover is movable relative to the elongated carrier for controlling a light effect originating from the at least one light source, wherein the at least one light source comprises a LED light source;

wherein the adjustable cover is moveable with respect to the carrier in the direction perpendicular to the direction defined by the shortest distance between the third side and the fourth side, whereby said perpendicular direction is the direction defined by the shortest distance between the first side and the second side; and wherein the at least one light source comprises a high density LED strip with at least 90 LED light sources per meter.

2. The lighting device according to claim 1, wherein the light effect originating from the at least one light source on the first and second face of the elongated carrier is controlled simultaneously by the positioning of the adjustable cover with respect to the elongated carrier.

3. The lighting device according to claim 1, wherein the shortest distance between the third face and a fourth face is equal to or smaller than four times the width of the largest light source present in the lighting device, wherein the width of the largest light source is defined by the shortest direction between the third side and the fourth side, and wherein the largest light source is defined as the light source having the largest width.

4. The lighting device according to claim 1, wherein the surface-mountable elongated carrier consists out of a single piece.

5. The lighting device according to claim 1, wherein the at least one light source and the adjustable cover are arranged for generating a light effect.

6. The lighting device according to claim 1, wherein the adjustable cover is only moveable with respect to the carrier in the direction perpendicular to the direction defined by the shortest distance between the third side and the fourth side, whereby said perpendicular direction is the direction defined by the shortest distance between the first side and the second side; and the at least one light source comprises two LED strips; whereby the first LED strip is located on the first face and the second LED strip on the second face of the elongated carrier; and the light effect originating from the LED strips on the first and second face is controlled simultaneously by the positioning of the adjustable cover with respect to the elongated carrier; and the shortest distance between the third face and the fourth face is equal to or smaller than four times the width of the largest LED strip, wherein the width of the first LED strip is defined by the shortest direction between the third side and the fourth side, and wherein the largest LED strip is defined as the LED strip having the largest width.

7. The lighting device according to claim 1, wherein the adjustable cover is made out of a flexible material.

8. A system comprising a lighting device according to claim 1 and a control unit, wherein the control unit is arranged for receiving an input signal containing a command and for sending out a control signal based on the command; and wherein the lighting device comprises an electrically activated moving mechanism for moving the adjustable cover relative to the elongated carrier; and wherein the control signal of the control unit drives the movement of the adjustable cover by activating the electrically activated moving mechanism; and/or wherein the control signal of the control unit drives the at least one light source to generate a light effect.

9. The system according to claim 8, wherein the control unit comprises a communication device to communicate with other devices, wherein other devices are selected from the groups consisting of sensors, lighting devices or home electronics.

10. A lighting device comprising a surface-mountable elongated carrier for positioning relative to a surface, at least one light source, and an adjustable cover;

wherein the elongated carrier comprises opposite to each other, a first face on a first side and a second face on a second side, the at least one light source is located on the first and second face; and wherein the elongated carrier comprises a third face on a third side for facing the surface in mounted position; and wherein the adjustable cover is in connection with the carrier and is positioned on a fourth side of the carrier opposite to the third side, and wherein the adjustable cover is movable relative to the elongated carrier for controlling a light effect originating from the at least one light source, wherein the at least one light source comprises a LED light source;

wherein the adjustable cover is moveable with respect to the carrier in the direction perpendicular to the direction defined by the shortest distance between the third side and the fourth side, whereby said perpendicular direction is the direction defined by the shortest distance between the first side and the second side; wherein the adjustable cover is at least partly made out of a translucent material, and wherein the adjustable cover comprises an enclosing surface on which LEDs are located facing inwards, such that the adjustable cover is illuminated by said LEDs.

11. A lighting device comprising a surface-mountable elongated carrier for positioning relative to a surface, at least one light source, and an adjustable cover;

wherein the elongated carrier comprises opposite to each other, a first face on a first side and a second face on a second side, the at least one light source is located on the first and second face; and wherein the elongated carrier comprises a third face on a third side for facing the surface in mounted position; and wherein the adjustable cover is in connection with the carrier and is positioned on a fourth side of the carrier opposite to the third side, and wherein the adjustable cover is movable relative to the elongated carrier for controlling a light effect originating from the at least one light source, wherein the at least one light source comprises a LED light source;

wherein the adjustable cover is moveable with respect to the carrier in the direction perpendicular to the direction defined by the shortest distance between the third side and the fourth side, whereby said perpendicular direction is the direction defined by the shortest distance between the first side and the second side; wherein the adjustable cover is at least partly made out of a translucent material, and wherein the adjustable cover comprises separately at least a first cover and a second cover, whereby the at least first cover and second cover are adjustable individually to determine the overall positioning of the adjustable cover with respect to the carrier.

12. A lighting device comprising a surface-mountable elongated carrier for positioning relative to a surface, at least one light source, and an adjustable cover;

wherein the elongated carrier comprises opposite to each other, a first face on a first side and a second face on a second side, the at least one light source is located on the first and second face; and wherein the elongated carrier comprises a third face on a third side for facing the surface in mounted position; and wherein the adjustable cover is in connection with the carrier and is positioned on a fourth side of the carrier opposite to the third side, and wherein the adjustable cover is movable relative to the elongated carrier for controlling a light effect originating from the at least one light source, wherein the at least one light source comprises a LED light source;

wherein the adjustable cover is moveable with respect to the carrier in the direction perpendicular to the direction defined by the shortest distance between the third side and the fourth side, whereby said perpendicular direction is the direction defined by the shortest distance between the first side and the second side; wherein the adjustable cover is at least partly made out of a translucent material, and wherein the lighting device further comprises an electrically activated moving mechanism for moving the adjustable cover relative to the elongated carrier.

13. A lighting device comprising a surface-mountable elongated carrier for positioning relative to a surface, at least one light source, and an adjustable cover;

wherein the elongated carrier comprises opposite to each other, a first face on a first side and a second face on a second side, the at least one light source is located on the first and second face; and wherein the elongated carrier comprises a third face on a third side for facing the surface in mounted position; and wherein the adjustable cover is in connection with the carrier and is positioned on a fourth side of the carrier opposite to the third side, and wherein the adjustable cover is movable relative to the elongated carrier for controlling a light effect originating from the at least one light source, wherein the at least one light source comprises a LED light source; and wherein the adjustable cover is only moveable with respect to the carrier in the direction perpendicular to the direction defined by the shortest distance between the third side and the fourth side, whereby said perpendicular direction is the direction defined by the shortest distance between the first side and the second side; and wherein the at least one light source comprises a high density LED strip, wherein the high density strip prevents pixilation of LEDs on the high density LED strip.

* * * * *